United States Patent [19]

Gross et al.

[11] 4,256,306

[45] Mar. 17, 1981

[54] SPINNING TOP HOCKEY-TYPE GAME

[75] Inventors: Raymond J. Gross, Culver City; Lane M. Buscho, Westwood, both of Calif.

[73] Assignee: Mattel, Inc., Hawthorne, Calif.

[21] Appl. No.: 12,525

[22] Filed: Feb. 15, 1979

[51] Int. Cl.[3] ..... A63F 7/07; A63F 7/28; A63H 1/02

[52] U.S. Cl. ..... 273/85 R; 273/85 F; 273/108; 46/67

[58] Field of Search ..... 273/85, 108; 46/67

[56] References Cited

U.S. PATENT DOCUMENTS

| | | | |
|---|---|---|---|
| 1,158,413 | 10/1915 | Zepp | 273/108 |
| 2,150,515 | 3/1939 | Meyer | 273/85 A |
| 2,318,169 | 5/1943 | La Rock | 273/85 A |
| 2,824,739 | 2/1958 | Frank | 273/85 R X |
| 2,971,288 | 2/1961 | Gill | 46/67 |
| 3,466,042 | 9/1969 | Lucci | 273/85 A |
| 3,680,864 | 8/1972 | Peterson | 273/108 X |
| 3,756,603 | 9/1973 | Goldfarb | 273/108 |
| 4,002,338 | 1/1977 | Gamber | 273/85 F X |

FOREIGN PATENT DOCUMENTS

| | | | |
|---|---|---|---|
| 548574 | 11/1957 | Canada | 273/85 A |
| 436523 | 10/1935 | United Kingdom | 273/108 |

OTHER PUBLICATIONS

Playthings Magazine, vol. 58, No. 3, p. 11 3-1960, No. 700—Tudor Hockey Game.

*Primary Examiner*—Paul E. Shapiro
*Attorney, Agent, or Firm*—John G. Mesaros; Max E. Shirk; Ronald M. Goldman

[57] ABSTRACT

A game having a playing surface for receiving a spinning top propelled onto the surface by a top spinning mechanism at the general midpoint of the playing surface. First and second oppositely disposed siderails are provided with the edges thereof a predetermined height above the playing surface for impacting with the top, the edges being angularly inclined outwardly from the midpoint toward opposite ends of the playing surface. First and second barrier members are provided at opposite ends of the playing surface with each of the barrier members having at least one opening for passage therethrough of the spinning top. A blocker member is slidably mounted on each barrier member for manual operation by opposing players for protecting against passage of the top through the opening with each barrier member having a tongue portion extending toward the playing surface with the tongue portion being configured for redirecting the top, upon impact therewith, back onto the playing surface.

16 Claims, 10 Drawing Figures

FIG. 4
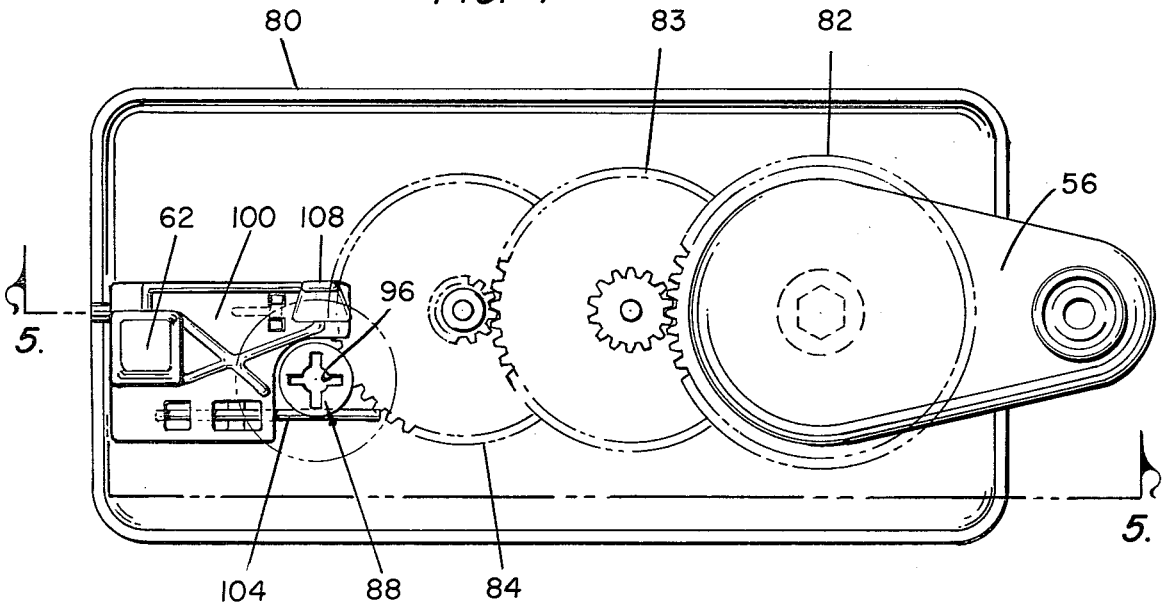
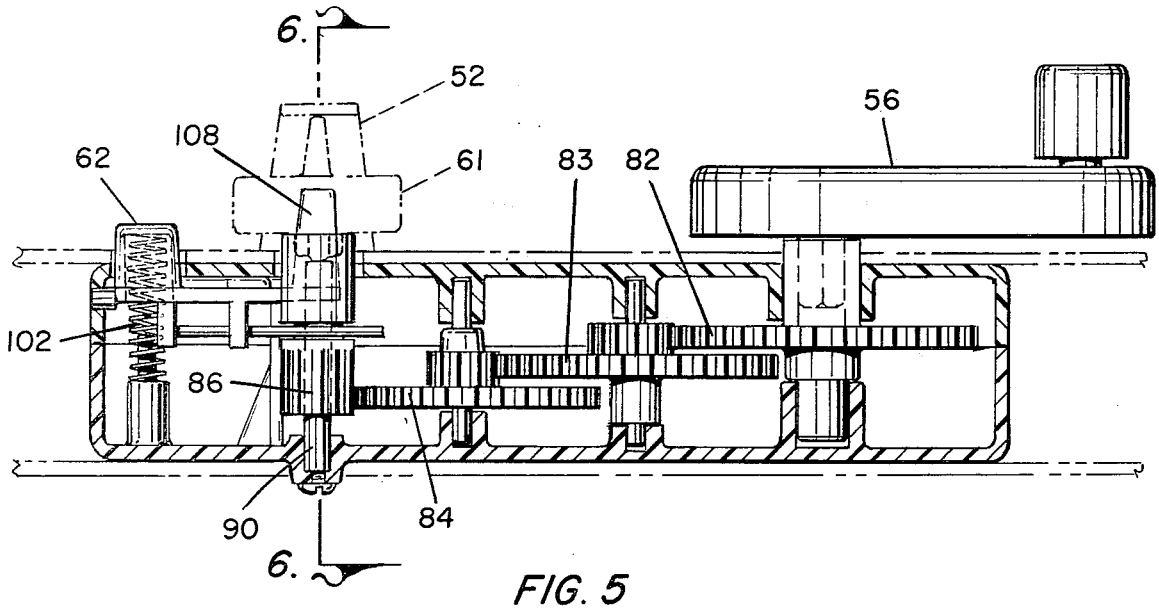
FIG. 5

SPINNING TOP HOCKEY-TYPE GAME

CROSS-REFERENCE TO RELATED PATENT APPLICATION

This application is related to the invention shown and described in U.S. patent application Ser. No. 965,972, filed Dec. 4, 1978, for "Spinning Top Pinball-Type Game" by Larry A. Sims, Gerard L. Lambert, Raymond J. Gross, and Harold B. Collins, such application being assigned to the assignee of the present application.

BACKGROUND OF THE INVENTION

The background of the invention will be discussed in two parts:

1. Field of the Invention

This invention relates to games, and more particularly to a game using a spinning top.

2. Description of the Prior Art

Spinning tops have provided a source of amusement for children, and various games have been developed utilizing spinning tops which are propelled along a playing surface for impact with one or more obstacles, or with other spinning tops, such games being shown and described, for example, in U.S. Pat. Nos. 2,252,451; 2,627,412; and 3,712,619. In the aforementioned patents, a top spinning device is provided for accelerating the top for propulsion along a playing surface which may have movable obstacles which are struck by the top, the number of obstacles so struck providing the scoring.

In the device of the above mentioned patent application, the game configuration is in the form of a pinball-type game in which the top is rotated by a top spinning device to high rotational speeds and then directed onto a playing surface having obstacles thereon for redirecting the top toward a mechanical scoring mechanism. Operator interaction is provided by "flipper" members positioned adjacent one end of the playing surface for redirecting the top upwards along the inclined playing surface toward the scoring mechanism at the other end.

It is an object of the present invention to provide a new and improved spinning top game.

It is another object of the present invention to provide a new and improved spinning top game with the housing and playing surface thereof configured to simulate a hockey game.

It is a further object of the present invention to provide a new and improved spinning top hockey-type game for two players.

SUMMARY OF THE INVENTION

The foregoing and other objects of the invention are accomplished by providing a game having a housing with a generally planar surface adapted for positioning generally parallel and level. The housing includes first and second siderails having edges defining opposite sides of the playing surface with the edges being generally co-planar at a predetermined height above the playing surface less than the height of the top. The edges are angularly inclined outwardly toward opposite ends from the midpoint thereof with the opposite ends having barrier members with each of the barrier members having first and second openings configured for passage of the top therethrough into top receiving pockets. A player manipulated blocker member is slidably positioned on each of the barrier members for control by the players to prevent passage through the openings of the top, with each blocker member including a tongue portion extending outwardly toward the playing surface for impact with an upper part of the top. The housing further includes a centrally disposed top spinning mechanism for rotating the top to high rotational speeds with the mechanism including a release mechanism for directing the spinning top onto the playing surface adjacent the midpoint thereof.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 4 is a top plan view of the top-spinning module used in the game of FIG. 1 with the top cover thereof removed;

FIG. 5 is a side view, partially in cross-section and partially broken away, of the top-spinning module of FIG. 4 as viewed generally along line 5—5 thereof;

DESCRIPTION OF THE PREFERRED EMBODIMENT

Figure 1:
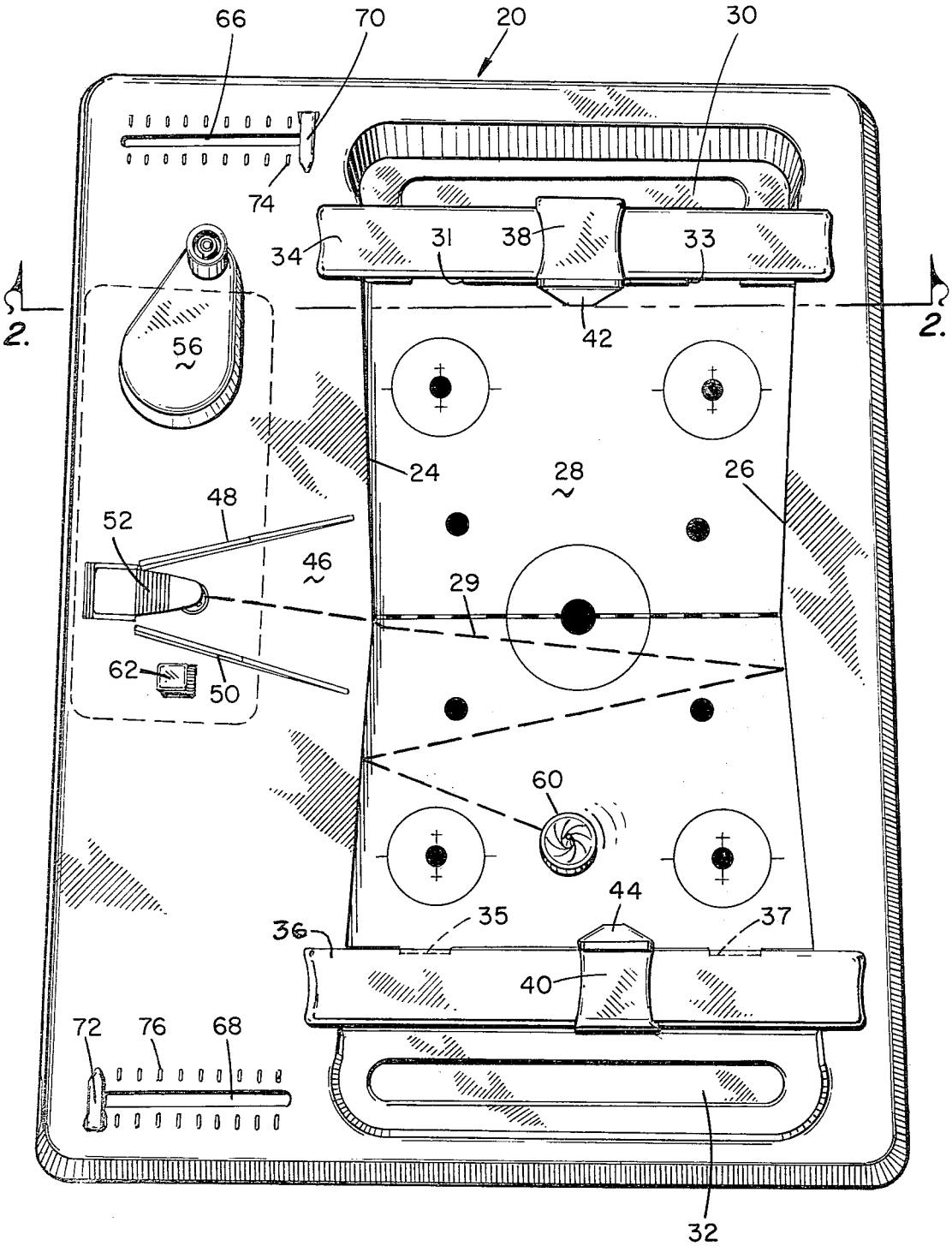
FIG. 1 is a plan view of the spinning top hockey-type game according to the invention.

Referring now to the drawings and particularly to FIG. 1 there is shown a spinning top hockey-type game according to the invention which includes a housing generally designated 20 which is generally rectangular in outer configuration with an upper surface generally designated 22 being provided with an enlarged opening therein defined by first and second oppositely disposed siderails 24 and 26 respectively. Recessed within the opening and generally parallel to the upper surface 22, there is supported within the housing a playing surface 28 which is generally planar and mounted within the housing 20 so that with the housing resting on a support surface such as a table or the like, the playing surface 28 is generally level. On either end of the playing surface 28, the housing 20 is provided with top receiving pockets 30 and 32 which may be formed integrally with the housing 20 with the pockets 30 and 32 being recessed from the plane of the playing surface 28. Intermediate the playing surface 28 and the pockets 30 and 32, there are provided barrier members 34 and 36 respectively with each barrier member having slidably mounted thereon a blocker member 38 and 40 respectively. Each of the barrier members 34 and 36 is generally identically configured, as are the blocker members 38 and 40 respectively. Each of the blocker members 38 and 40 is provided with a tongue portion 42 and 44 respectively, with the tongue portions extending inwardly toward playing surface 28.

The housing 20 has integrally formed in the surface 22 thereof a chute area 46 defined by angularly disposed ribs 48 and 50 which diverge playing surface 28 at the approximate midpoint thereof from a top receiving or retaining projection 52 which is part of a top-spinning module 54 (shown in dotted lines). The module 54 is provided with a rotatable handle 56 which, is rotated to high speeds with the top beneath the top retaining projection 52. After a predetermined speed is achieved, a release button 62 is depressed, and as will hereinafter be described, an ejection mechanism propels the top 60 toward the approximate midpoint of the playing surface 28 by means of chute 46, the top 60 then dropping onto the playing surface 28 to be directed along the surface 28 by reason of the angularly inclined edges of siderails 24 and 26 toward one or the other of the playing surface 28. As the top proceeds toward one end or the other, the player then operates or slides a blocker member such as blocker member 40 to redirect the top back toward the playing surface.

Each barrier 34 and 36 is provided with one or more openings through which the top 60 may pass unobstructed unless the blocker member is appropriately positioned over the opening. For example, barrier member 34 is provided with openings 31 and 33 (shown in dotted lines) while barrier member 36 is provided with similar openings 35 and 37.

In order to enhance the amusement value of the game, the housing 20 is provided with scoring means adjacent opposite player positions. The scoring mechanism is relatively simple and includes slots 66 and 68 respectively formed at the upper and lower positions with each of the slots having slidable therein pointer members 70 and 72 respectively for positioning at one or more detentable locations from by the series of detents or ribs 74 and 76 respectively formed integrally with the upper surface 22 of the housing 20 on opposite sides of the slots 66 and 68 respectively.

Figure 2:
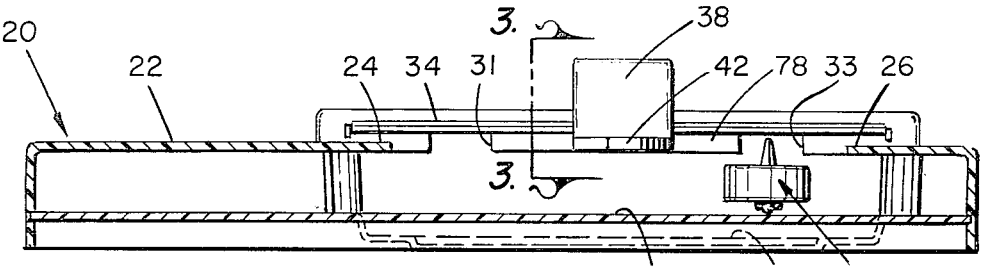
FIG. 2 is a cross-sectional view taken generally along line 2—2 of FIG. 1.
Figure 3:
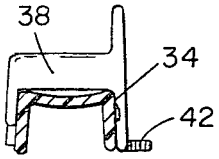
FIG. 3 is a cross-sectional view taken generally along line 3—3 of FIG. 2.
Figure 10:
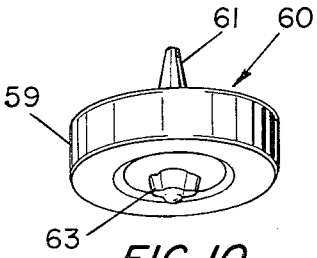
FIG. 10 is a bottom perspective view of the top of FIG. 9 as viewed generally along line 10—10 thereof.
Figure 9:
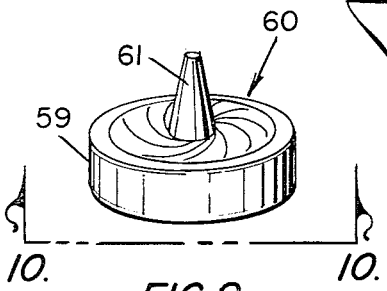
FIG. 9 is a top perspective view of the top used in the game of FIG. 1.

As best illustrated in FIGS. 2 and 3, the barrier 34 is configured to be positioned on top of the upper surface 22 of the housing 20 and is provided with a depending flange 78 which is suitably cut away to provide the openings 31 and 33 with the overall height to the upper edge of the cut away portion being slightly greater than the overall height of the top 60. The width of the cut out forming the openings 31 and 33 is much greater than the width of the upper stem of the top 60 to provide a certain range through which the top 60 may pass into the top receiving pocket 32. As depicted in FIG. 3, the barrier 34 is generally channel-shaped with the blocker member 38 being configured to straddle the channel portion and to be slidable relative to the length of the channel. The tongue portion 42 of the blocker member 38 is generally planar, extending in a plane parallel to the playing surface 24 and spaced at a distance less than the overall height of the top 60 for engaging the stem portion thereof. As best illustrated in FIG. 1, in plan view the tongue portion 42 is curved, or provided with three distinct edges, one of which is parallel to the line of sliding movement of the blocker member 38 with the opposite edges being angularly inclined rearwardly for redirecting the spinning top 60 back onto the playing surface.

As will hereinafter be described, the configuration of the top 60 (see also FIGS. 6–10) is arranged with an enlarged body portion 59 with a generally elongated tapered upper stem portion 61 and a stub-shaped pivot projection 63. The main body portion 59, as described in the aforementioned patent application, is generally cup-shaped with the greatest portion of the mass being in the bottom and sidewalls with the cup-shaped portion then filled with a suitable plastic or epoxy material to provide a smooth upper surface for the main body portion 59.

Figure 6:
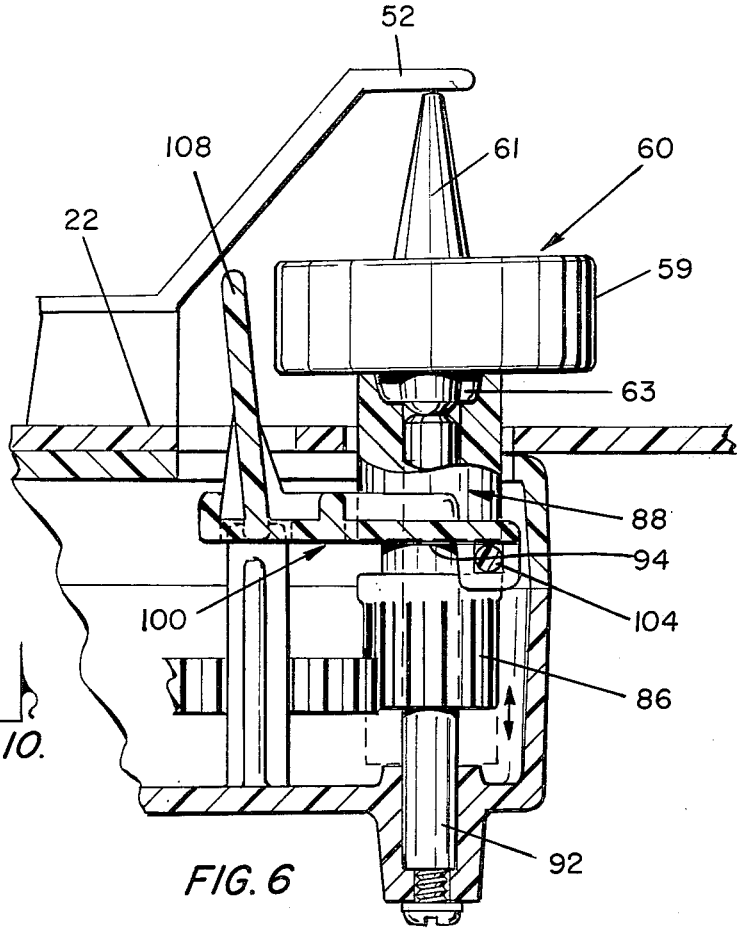
FIG. 6 is a side elevational view of a portion of the top-spinning mechanism, partially in cross-section and partially broken away as viewed generally along line 6—6 of FIG. 5.

The top 60 is rotated to high speeds by means of the module 54 which is illustrted in FIGS. 4–6 inclusive. The module 54, in operation and configuration is substantially similar to the top-spinning mechanism shown and described in the aforementioned patent application, and includes a housing 80 having a gear train including first, second and third gear members 82–84 inclusive providing a gear train with a step-up ratio. The handle 56 rotates gear member 82 which then drives gear member 83 and ultimately gear member 84, the enlarged gear portion of which engages a pinion portion 86 of an axially slidable member generally designated 88. Slidable member 88 slides on a shaft 90 and is provided with a reduced diameter collar portion 94 (see FIG. 6), the upper surface of member 88 extending above the upper surface 22 of housing 20.

As depicted in FIGS. 4 and 6, the member 88 has the upper surface thereof configured to form a cruciform 96 which is configured for keying the pivot projection 63 which normally rests therein as shown in FIG. 6 with the top retaining arm 52 abutting or in spaced proximate relation to the upper extremity of the stem portion 61 of the top 60. With the top 60 thus positioned, rotation of the handle 56 through the step-up ratio of the gear train accelerates the top 60 to very high rotational speeds of 10,000 to 20,000 RPM.

For releasing and ejecting the top 60 onto the playing surface 28, the module 54 is provided with a release mechanism which is actuated upon depression of the release button 62. As illustrated in FIGS. 4–6, the release button 62 is part of a release member 100 which is suitably pivoted within the housing 80 against the force of a spring 102 positioned beneath release button 62. Adjacent one end of release lever 100, there is affixed thereto a pin 104 which extends into the reduced diameter collar portion 94 of the slidable member 88, and upon depression of release lever 62, the pin member 104 urges member 88 downwardly as viewed in FIG. 6 until the upper surface of member 88 is below the pivot projection 63 of top 60 to enable release thereof onto the surface of the chute 46. To facilitate removal or ejection of the top 60, the release lever member 100 is also provided with a generally perpendicular upwardly extending kick arm 108, the free end of which is normally positioned in spaced proximate relation to the outer periphery of the main body portion 59 of the top 60 when coupled to the top spinning mechanism as depicted in FIG. 6. As release button 62 is depressed, the kicker arm 108 is simultaneously pivoted to the dotted line position shown in FIG. 6 to thereby impact against the body 59 urging the top 60 outwardly over chute 46 where it then drops onto the playing surface 28 to initiate play of the game.

The top-spinning mechanism 54 in operation and general arrangement of parts is generally identical to the top-spinning mechanism in the above-identified Sims, et al. patent application, with the arrangement of the gear train being slightly different to accomodate the generally central location in the present invention. In addition, the release lever member 100 is configured differently with a slight functional change in which the pin 104 is located on the opposite side of the sliding member 88, as a result of which downward depression or pivoting of the member 100 in response to depression of the release button 62 urges pin 104 inwardly within the reduced diameter collar portion 94 to insure constant engagement. Additionally, the top 60 identical to that used in the invention of the Sims, et al. patent application and further description with reference to the top-spinning mechanism 54 and top 60 is, by this reference, incorporated herein.

Figure 7:
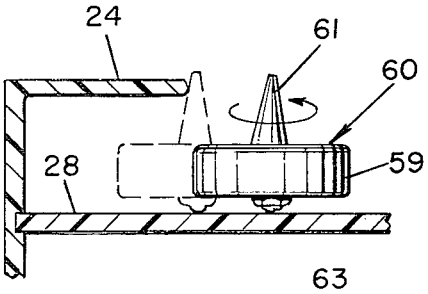
FIGS. 7 and 8 are diagrammatic side elevational views showing the operative relation between the spinning top and the side edges of the playing surface.
Figure 8:
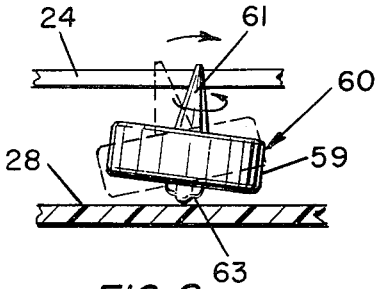

Referring now to FIGS. 1, 2, 7 and 8, the operation of the game will now be described. The top is positioned with the keyed pivot projection 63 within he cruciform opening 96 of the slidable member 88 as shown in FIGS. 5 and 6 on the handle mechanism 56 is rotated, thereby resulting in rotation at high rotational speeds of 10,000 to 20,000 RPM, depending on the gear ratio of the gear train. The release button 62 is then depressed, thereby lowering slidable member 88 and simultaneously pivoting kicker arm 108 to thereby eject the top 60 down the chute 46 whereupon it drops onto the playing surface 28 at the general midpoint thereof. The playing surface 28 may have suitably imprinted thereon certain lines or areas indicative of a hockey field, as depicted in FIG. 1. The top 60 functions and operates in the manner of a gyroscope, with the direction of movement of the top 60 on the playing surface 28 being dependent on impact of the stem 61 thereof which thus applies a torque tending to change the direction of the rotation axis of the top thereby redirecting the top along another line at an angle to the original direction line, this phenomena being generally referred to as the principle of gyroscopic precession. As shown in FIGS. 1 and 2, the siderails 24 and 26 are edges extending out over the playing surface so that the main body portion 59 of the top 60 may travel within the opening between the siderail 24 and the surface 28 as illustrated in FIG. 7, with the contact point of the top 60 being adjacent the upper end of the tapered stem portion 61 thereof. In FIG. 7, the top 60 is shown in solid lines traveling in a direction toward the edge of the siderail 24 with the top 60 rotating in a counterclockwise direction about the flat or semi-rounded bottom of the pivot projection 63. At this point, the axis of rotation of top 60 as viewed in end view is vertical to the plane of the playing surface 28, although by reference to FIG. 8, the dotted line depiction of top 60 illustrated in side view that the axis of rotation of top 60 is tilted at an angle to the playing surface 28. In order to effect redirection of the top 60, the axis of rotation thereof must be tilted slightly relative to the playing surface 28, this tilt being depicted in dotted lines in FIG. 8. As the stem portion 61 of the top 60 contacts the siderail edge 24 (as shown in dotted lines in FIG. 7) the axis of rotation thereof as viewed in end view in FIG. 7 still remains substantially vertical while tilting to the solid line position shown in FIG. 8 due to the torque applied to the stem portion 61 by virtue of the impact. The impact force on the top 60 will act in a direction 90° to the force in the direction of rotation, as a consequence of which, viewing FIG. 8, as the top 60 approaches the siderail 24 from the left into the paper with the rotational axis being tilted as shown in dotted lines, after impact, the rotational axis of top 60 will shift, due to the torque, to the solid line position in a direction out of the paper to the right. The small diameter of the stem portion 61 as well as the low center of gravity of the top 60 minimizes the transfer of energy upon impact thereby enabling the top 60 to maintain its rotation over a longer period of time.

To facilitate the play of the game, the edges of siderails 24 and 26 are not parallel, since a parallel arrangement could conceivably result in the top traveling back and forth along the ejection line of direction with no movement toward either opposite end of the playing surface 28. The edges of siderails 24 and 26 diverge outwardly relative to each other from the midpoint of playing surface 28 toward the opposite top-receiving pockets 30 and 32 to thereby enable the top 60 to traverse a path as shown in dotted lines and generally designated 29 on the playing surface 28 in FIG. 1. Upon initial release of the top 60 onto the playing surface, the top will ordinarily travel a path 29 in proximate relation to one side or the other of the intersection of the two lines which form the V of the siderail 26, the direction thereafter being generally confined to that side or half of the playing surface 28 until the top 60 is redirected along the playing surface 28 toward the other end by means of the tongue portion 44 of the blocker member 40.

As the top 60 approaches the barrier member 36 for example, the player defending the "goal" slides the blocker member 40 to enable impact of the stem portion 61 of the top 60 with the tongue portion 44 of blocker member 40. Upon impact with the tongue portion 44, depending on which portion of the tongue portion, the top 60 will be redirected back toward the middle of the playing surface 28 or toward either of the siderails 24 or 26 with the ultimate object being to redirect it toward the other half of the playing surface 28, where, by gyroscopic action, the top 60 will progress toward the opposite "goal." The other player then slides the blocker member 38 to prevent passage of the top 60 through either of the openings 31 or 33 which result in a score for the opposing player. Upon passage of the top 60 through one of the openings, the top will then rest in the recessed top-receiving pocket 30 or 32 depending on which opening the top passes through. The player then scoring moves his pointer member 70 to the next detent to indicate a score with the upper surface 22 being appropriately provided with indicia adjacent the detents for indicating the score.

Although the game of the present invention is relatively simple in construction and operation, due to the rapid movement of the top 60 prolonged play is possible due to the high rotational speeds of top 60, the angular inclinations of the siderails 24 and 26, the pairs of openings provided on each of the barrier members 34 and 36, with the skill of each player being a determining factor in redirecting the top 60 notwithstanding the lack of proximity of top 60 to the player' openings. While there has been shown and described a preferred embodiment, it is to be understood that various other adaptations and modifications may be made within the spirit and scope of the invention.

What is claimed is:

1. In a game, the combination comprising:

a generally planar playing surface;

a top having an enlarged main body portion and an elongated tapered stem portion;

top spinning means for directing said top onto said playing surface adjacent the middle thereof;

first and second means adjacent opposite ends of said playing surface configured for receiving said top during game play;

first and second oppositely disposed side rails intermediate said ends for defining a playing field, said side rails being spaced from said playing surface and configured for impact with the stem portion of the spinning top for redirecting said top toward one of the opposite ends; and first and second manually operable blocking means intermediate said playing field and said first and second means, said blocking means being configured at least in part for impact with said stem portion for enabling a player to redirect the spinning top toward the opposite end.

2. The combination according to claim 1 wherein each of said first and second side rails include edge portions which, in plan view, diverge toward said opposite ends from a midfield position of said playing surface.

3. The combination according to claim 2 wherein said blocking means includes a barrier member having at least one cutaway portion for passage therethrough of the top and a blocker member slidable relative to said barrier member.

4. The combination according to claim 3 wherein said blocker member has a tongue portion in generally parallel relation to said playing surface, said tongue portion being configured for impact with said stem portion of said top for redirecting the top onto the playing surface.

5. The combination according to claim 1 wherein said manually operable blocking means includes a barrier member having at least one cutaway portion for passage therethrough of the top and a blocker member slidable relative to said barrier member.

6. The combination according to claim 5 wherein each of said barrier members includes at least two cutaway portions.

7. The combination according to claim 6 wherein each of said first and second means is a top receiving pocket.

8. In a game, the combination comprising:

a top having an enlarged main body portion and an elongate stem portion;

a housing having a generally planar playing surface and an enlarged generally rectangular opening with first and second oppositely disposed long edges configured, in plan view, in divergent relation toward opposite ends from the general midpoint thereof, said edges being spaced from said playing surface for impact with said top;

a top spinning mechanism mounted at least partially within said housing adjacent said midpoint;

first and second top-receiving pocket means at each end of said opening in proximate relation to said playing surface; and first and second manually operable blocking means on said housing intermediate said playing surface and each of said pocket means for enabling a player to block the spinning top on the playing surface from entering said pocket means and for redirecting said top on said playing surface.

9. The combination according to claim 8 wherein each of said blocking means includes a barrier member on said housing having a cutaway portion configured for passage therethrough of said top and a blocker member slidable relative to said barrier member for blocking said cutaway portion.

10. The combination according to claim 9 wherein said housing further includes a chute portion in the surface thereof intermediate said top-spinning mechanism and the playing surface for directing said top onto the playing surface.

11. The combination according to claim 10 wherein said top spinning mechanism includes a rotatable handle for spinning said top and means for selectively retaining said top within said mechanism.

12. The combination according to claim 10 wherein each of said barrier members includes at least two cutaway portions.

13. The combination according to claim 12 wherein each of said barrier members is generally channel-shaped with a depending flange portion having the cutaway formed in said flange.

14. The combination according to claim 13 wherein each of said blocker members includes a torque portion extending toward said playing surface in a plane generally parallel thereto.

15. The combination according to claim 14 wherein each of said tongue portions is generally curved for redirecting the top in a direction determined by the portion of the tongue impacted.

16. The combination according to claim 14 wherein said playing surface is configured for simulating a hockey field.

* * * * *